United States Patent [19]

Nielsen et al.

[11] 4,084,994

[45] Apr. 18, 1978

[54] AQUEOUS HYDROCARBON OIL-SOLUBLE LIGNOSULPHONATE EXPLOSIVE COMPOSITION

[75] Inventors: Tore Bernt Nielsen; Oddvar Alm, both of Drammen, Norway

[73] Assignee: Dyno Industrier A.S., Oslo, Norway

[21] Appl. No.: 755,555

[22] Filed: Dec. 30, 1976

Related U.S. Application Data

[63] Continuation-in-part of Ser. No. 624,284, Oct. 20, 1975, abandoned.

[30] Foreign Application Priority Data

Mar. 14, 1975 Norway ..... 750887

[51] Int. Cl.[2] ..... C06B 33/02

[52] U.S. Cl. ..... 149/44; 149/41; 149/43; 149/60; 149/61; 149/87

[58] Field of Search ..... 149/41, 43, 44, 60, 149/61, 87

[56] References Cited

U.S. PATENT DOCUMENTS

| | | | |
|---|---|---|---|
| 3,369,945 | 2/1968 | Craig et al. | 149/41 X |
| 3,617,407 | 11/1971 | Craig et al. | 149/44 |

*Primary Examiner*—Stephen J. Lechert, Jr.
*Attorney, Agent, or Firm*—Wenderoth, Lind & Ponack

[57] ABSTRACT

The present invention relates to an aqueous explosive composition which consists of at least one inorganic oxygen-supplying substance, at least one combustible substance and at least one thickening agent, at least one of combustible substance being liquid and substantially water insoluble and the aqueous phase of the explosive composition having dissolved therein a lignosulphonate in an amount of up to 5% of the weight of the explosive composition.

7 Claims, No Drawings

AQUEOUS HYDROCARBON OIL-SOLUBLE LIGNOSULPHONATE EXPLOSIVE COMPOSITION

This application is a continuation-in-part of application Ser. No. 624,284, filed Oct. 20, 1975 (now abandoned).

This invention relates to such explosive compositions frequently called slurry explosives consisting of an aqueous composition of oxygen-supplying salts and combustible substances of various kinds.

Particularly, the invention relates to such explosive compositions in which the combustible substances are or comprise a liquid substance substantially insoluble in water.

In the patent literature substances of various kinds have been discussed as oxygen-supplying and combustible components in the so-called slurry explosives. Among solid substances not being explosive by themselves, i.e. bituminous substances, various organic substances, and metals have been suggested and taken into use. These substances have in common that the degree to which these combustible substances are finely dispersed is important to properties of the explosive manufactured therefrom.

As an individual group of slurry explosives those must be considered which contain a liquid, substantially water-insoluble substance. The most frequently discussed slurry explosives of this group contain hydrocarbons of various kinds, normally petroleum fractions called fuel oils or diesel oils as the combustible component of the composition.

Thus, the manufacture of explosives of this kind is known from U.S. Pat. No. 3,161,551. In said specification the use of a hydrophobic emulsifier is also suggested, in which the emulsifier is able to form a water-in-oil emulsion as a characterizing feature of the explosive disclosed. In Australian Pat. No. 281,537 similar explosives have been disclosed and also the use of anionic surface active substances therein. Such explosives which contain a liquid combustible material being substantially insoluble in water normally also contain thickening agents of known character, preferably guar gum and, naturally, also can contain other components. Thus, explosives which contain aluminium powder in addition to a fuel oil have been disclosed in U.S. Pat. No. 3,094,069.

Naturally, it is important to the properties of the explosive produced also when liquid fuels are used, to which extent these are finely dispersed, that is how the emulsion of fuel and the aqueous salt solution is provided and that it is stable. Thus, it has been stated that the emulsifiers being used should be hydrophobic and stabilize a water-in-oil emulsion. It has also been suggested to allow the fuel to be absorbed by the ammonium nitrate present in the form of porous prills before they are used in the production of the final composition.

The present invention consists partly in using such a component in the explosive composition that the liquid fuel is very easily dispersed in an aqueous salt solution and that the emulsion obtained is very stable. Surprisingly, it has been found that lignosulphonates which are present in the so-called sulphite liquors from the production of wood pulp according to the sulphite cellulose method are a particularly well suited component in slurry explosives containing a liquid fuel. These lignosulphonates are water soluble contrary to the previously suggested emulsifiers for slurry explosives comprising liquid fuels and it is presumed that the lignosulphonates stabilize an emulsion of the type oil-in-water. The emulsifying and emulsion stabilizing effect of lignosulphonates is previously known per se, but it has not been known that this effect is so evident in a system in which the water phase is a saturated solution of oxygen supplying salts, preferably nitrates.

Using lignosulphonates in slurry explosives is previously known from Canadian Pat. specification No. 784,636. In this patent only slurry explosives are disclosed in which the fuel consists of solid substances or water soluble substances, and, thus, the specification does not disclose any use of or particular advantages of lignosulphonates in connection with liquid water-insoluble fuels which is a characterizing feature of the present invention.

In said Canadian patent lignosulphonates are designated a sensitizer, i.e. an agent which increases the sensitivity of the explosive to initiators, however, without presenting any explanation of, or theory for this sensitizing effect. It is a feature of the present invention that this sensitivity increasing effect manifests itself when the fuel of the explosive is a liquid substance. Therefore, the invention consists mainly in the fact that the very same substance both is an effective emulsifier for liquid fuels and a sensitivity increasing component of the composition. Furthermore, it is a feature of the present invention that lignosulphonates have additional advantageous effects relative to previously known emulsifiers for slurry explosives comprising liquid fuels. In many cases it is advisable to convert the aqueous thickened salt solution of the explosive into a gel by means of a so-called crosslinking agent for the high polymer molecules of the thickener, thereby providing, i.e., a considerably improved water resistance of the explosive. As crosslinking agents compounds of heavy metals from the periodical system groups 4, 5 or 6 in their highest valences are particularly mentioned, such as chromates, antimonates or titanates. It is known per se that the reactions causing this crosslinking or gel formation proceed more rapidly or more completely in the presence of reduction agents. Thus, it is also a feature of the present invention that lignosulphonates are suitable as such an auxiliary means for the gel formation, contrary to what is the case with previously suggested emulsifiers. Thus, considered as a whole, it has surprisingly been found that lignosulphonates altogether have three separate advantageous effects in the said class of explosives which renders the use of different components for each of said functions superfluous.

Finally, it is a feature of the present invention that the use of lignosulphonates in connection with liquid fuels implies considerable economical advantages. Lignosulphonates are much cheaper than most known or suggested emulsifiers for slurry explosives comprising liquid fuels. They are also cheaper than the reduction agents being suggested as means for crosslinking reactions with chromates and antimonates. Also considered in relation to the use of solid fuels the present invention implies that all expenses are removed for crushing and grinding of the solids, since the dispersion of the liquid fuels is taking place during the mixing operation bringing about the finished explosive. Furthermore, an economical advantage is found in the fact that common fuel oil is cheaper than most solids which have been suggested up to now as fuels in slurry explosives. The compositions of the invention are free from self-explosive matter, nitroderivatives, nitric acid esters and chlorinated hydrocarbons.

In the practice of the present invention no method is critically important and the mixing of the explosive components may be carried out in many different ways. A preferred method is to prepare an aqueous solution of the oxygen supplying salt(s), thickener(s) and lignosulphonates and thereafter add the liquid fuel in a simple mixing operation, wherein certain quantities of undissolved salts and other combustible substances, such as metal powder or the like, may be added. Auxiliary agents in small quantities to control the density and consistency of the explosive, such as gas generating reagents, e.g. sodium nitrite and crosslinking agents such as chromates, titanates or antimonates, respectively, may be added in the same mixing operation, if desired.

The compositions of the invention are aqueous compositions and contain a range of from 5 to 15% water based upon the weight of the composition.

The mixing operation and the equipment for carrying out the operation are neither critical to the practice of the invention, but a certain effect of the mixing intensity can sometimes be observed on such quality measures of the explosive as the critical diameter.

Thus, a prepared solution of oxygen supplying salts, thickeners and a lignosulphonate may be brought together with the liquid fuel and optionally other components in a plastic bottle and shaken by hand, whereby within one minute a sufficiently intimate mixture is obtained which can be squeezed out of the plastic bottle into suitable tubes or the like and then successfully be brought to detonate by means of conventional initiators. Obviously, the same mixing operation may be performed chargewise in so to say any size mixing equipment whereby mixing periods of the order of one or a few minutes usually will be sufficient. A particularly preferred method in carrying out the mixing operation is to allow the aqueous solution of the oxygen supplying salt or salts, thickeners and the lignosulphonate to continuously run together with the liquid fuel optionally with simultaneous supply of some quantities of undissolved salt and combustible solids and other agents into a mixing chamber with a mechanical stirrer, from which chamber the ready prepared explosive flows continuously and is pumped either directly into a blast hole or to a cartridging machine of suitable kind.

In such a continuous mixing operation whereby accumulation of large quantities of ready made and detonatable explosive is avoided, the volume of the mixing chamber may be as small as 1 to 2 liters for a flow through of an explosive quantity with a volume of about 20 liters per minute. By such means the mixing operation may be carried out between 3 to 6 seconds as an average with such an effective emulsification of the liquid fuel in the salt solution that the explosive produced is fully satisfactory for application in blast holes of diameters above 2 inches.

When practising the invention it is not critical what kind of lignosulphonates are being used or in which form they are present. Thus, so-called sulphite liquors evaporated to a dry content of about 50%, the rest substantially being water or substances evaporated to dryness and present as powder may be used. Lignosulphonates of sodium, calcium, magnesium and ammonium may be used, dependent of which bases are used in the sulphite cellulose process. Nor is it critical in any way in practising the invention whether the lignosulphonate material contains various other water soluble components, such as various sugars extracted from the raw material for the production of cellulose, or whether these sugars are removed by fermentation before evaporating to about 50% or nearly to 100% dry content.

The lignosulphonates which according to the invention should be included in the final explosive composition are used in amounts of up to 5% of the total composition and preferably in amounts of between 0.5 and 2%.

To further illustrate the invention the following examples are given on some embodiments of the invention wherein both the mixing operations are carried out in different ways and wherein some examples have been carried out without lignosulphonates for comparison of the obtained results.

EXAMPLES

In the following table a total of five examples are summarized, Examples 4 and 5 being outside the invention and are included for reason of comparison as far as they simultaneously do not contain lignosulphonate and a liquid fuel.

The method of preparation is also varied, but all examples have in common that a solution consisting substantially of nitrates and water is first prepared and maintained at a temperature of about 45° C, until the mixing operation with the remaining components is taking place. In this solution also the thickener guar gum is included which is first dispersed in glycol to prevent lump formation; furthermore, thiourea as a reaction partner for the aerating agent nitrite so that a certain amount of nitrogen is generated and finely distributed throughout the final mixture, and also the antifoaming agent "Foamaster 50D", marketed by the company Nopco Senco, to avoid varying occlusions of air in the explosive composition. Finally, the solution according to all examples except Example 4 contains a lignosulphonate, viz., the commercial product denoted "Totanin MG" from A/S Toten Cellulosefabrikk, Nygard, Norway.

The ammonium nitrate used is a commercial grade available in prilled form. The lime saltpeter used is also a commercial grade in the form of prills containing about 15% of water and about 6% of ammonium nitrate in addition to calcium nitrate.

As fuel a diesel oil of normal commercial grade has been used.

The auxiliary substances sodium dichromate for crosslinking the guar gum and sodium nitrite for generating nitrogen are added during the final mixing operation in the form of separate solutions, 50% and 25% concentration, respectively. All figures in the composition table are given in weight percent.

TABLE I

| Composition No. | 1 | 2 | 3 | 4 | 5 |
|---|---|---|---|---|---|
| Solution: | | | | | |
| Ammonium nitrate | 29.00 | 29.00 | 29.00 | 29.33 | 29.00 |
| Lime saltpeter commercial grade | 28.18 | 28.18 | 28.18 | 28.18 | 28.18 |
| Water | 6.29 | 6.29 | 6.29 | 6.29 | 6.29 |
| Thiourea | 0.13 | 0.13 | 0.13 | 0.13 | 0.13 |
| Guar Gum | 0.36 | 0.36 | 0.36 | 0.36 | 0.36 |
| Lignosulphonate | 0.53 | 0.53 | 0.53 | — | 0.53 |
| Ethylene glycol | 0.78 | 0.78 | 0.78 | 0.98 | 0.78 |
| Antifoaming Agent | 0.03 | 0.03 | 0.03 | 0.03 | 0.03 |
| Fuels: | | | | | |
| Diesel Oil (fuel oil) | 6.50 | 6.50 | 6.50 | 6.50 | — |
| Gilsonite | — | — | — | — | 6.50 |
| Undissolved ammonium nitrate | 28.00 | 28.00 | 28.00 | 28.00 | 28.00 |
| Auxiliary substances: | | | | | |

TABLE I-continued

| Composition No. | 1 | 2 | 3 | 4 | 5 |
|---|---|---|---|---|---|
| Sodium dichromate | 0.10 | 0.10 | 0.10 | 0.10 | 0.10 |
| Sodium nitrite | 0.10 | 0.10 | 0.10 | 0.10 | 0.10 |

Different mixture methods are used in the various embodiment examples.

In Example 1 the solution, fuel, dry ammonium nitrate and auxiliary substances are brought together in the order mentioned in a plastic bottle having a volume of about 2 liters and shaken together for about 15 seconds. Thereupon the prepared mixture, before a complete crosslinking of the guar gum has taken place, is transferred into cardboard tubes of various diameters for testing of the explosive quality parameters.

In Example 2 the composition has been prepared in a mixing apparatus commonly used for bakery purposes with a mixing vessel having a volume of about 25 liters. After charging the solution the fuel oil was added and stirred until the mixture look homogenous, which was obtained within about one minute. During somewhat more vigorous stirring dry ammonium nitrate and the auxiliary substances were added and stirring maintained for about one minute. Then the prepared mixture was put into cardboard tubes as in Example 1.

In Examples 3, 4 and 5 a continuous mixing process was used wherein the components were passed into a mixing chamber having a volume of about 1 liter. The charging rate was about 10 kgs per minutes and samples of the final mixture were brought into cardboard tubes of various diameters for the determination of the critical diameters. In all cases the density of the product was about 1.15 g/cm$^3$. The results are stated in Table II. The stated critical diameter for the explosive mixtures is the smallest diameter where a tube, having a length 6 times the diameter, detonates completely unconfined having been cooled down to 5° C and initiated with a primer. As primer for tube diameters below 84 mm 32 g of trinitro-toluene has been used, in the table denoted as "A", whilst for larger tube diameters 360 g of pentolite (55% pentrite, 45% trinitro-toluene), in the table denoated "B" has been used.

TABLE II

| Example No. | 1 | 2 | 3 | 4 | 5 |
|---|---|---|---|---|---|
| Primer, type: | A | A | A | B | B |
| Critical diameter, inches: | 2 | 2¾ | 2¾ | 4 | >5¾ |

From the above results it can be seen that with diesel oil as fuel, lignosulphonate provides a critical diameter below 3 inches whilst lack of lignosulphonate, all other conditions being unchanged, provides a critical diameter of 4 inches even with a substantially stronger primer. Other lignosulphonate compositions provided results nearly identical to those obtained with "Totanin MG". For a solid fuel, gilsonite, even with lignosulphonate it is obtained a critical diameter above 5¾ in. which was the largest diameter tested.

It will also be seen that the rapid mixing by shaking in a plastic bottle provides a somewhat lower critical diameter than a mechanical mixing whilst the continuous mixing and the mechanical chargewise mixing are of equal value.

The ratio of ammonium nitrate to calcium nitrate is not critical, nor is the amount of ammonium nitrate added as dry solid matter, which optionally may be substituted by an amount of nitrate solution. Table III gives examples of various compositions which all have been prepared by the continuous method as used in Examples 3, 4 and 5 above.

TABLE III

| Composition No. | 6 | 7 | 8 |
|---|---|---|---|
| Solution: | | | |
| Ammonium nitrate | 30.98 | 41.39 | 39.57 |
| Lime saltpeter, comm. grade | 30.02 | 39.95 | 38.18 |
| Water | 6.70 | 8.92 | 8.52 |
| Thiourea | 0.14 | 0.19 | 0.18 |
| Guar gum | 0.38 | 0.51 | 0.49 |
| Lignosulphonate | 0.50 | 0.50 | 0.50 |
| Ethylene glycol | 1.05 | 1.39 | 1.33 |
| Antifoaming agent | 0.03 | 0.05 | 0.03 |
| Fuels: | | | |
| Diesel oil (fuel oil) | 4.70 | 6.90 | 5.00 |
| Atomized aluminum | 6.00 | — | 6.00 |
| Undissolved ammonium nitrate | 19.30 | — | — |
| Auxiliary substances: | | | |
| Sodium dichromate | 0.10 | 0.10 | 0.10 |
| Sodium nitrite | 0.10 | 0.10 | 0.10 |
| Primer, type | A | A | A |
| Critical diameter, inches | 2¾ | 2¾ | 2¾ |

As it is seen, the modifications do not influence the sensitivity of the explosive composition, as judged from the observed critical diameter.

A series of tests have been performed with emulsifiers other than lignosulphonate. The agents tested were stated by the suppliers to be effective for emulsification of oil in water containing salts, and are presented in Table IV.

TABLE IV

| Denotification | Supplier |
|---|---|
| "LDC Base" | Company Nopco Senco, Drammen, Norway |
| "1225-L" | Company Nopco Senco, Drammen, Norway |
| "1186 A" | Company Nopco Senco, Drammen, Norway |
| "Type 09" | Hexamin Products, Royken, Norway |
| "Type 79/02" | Hexamin Products, Royken, Norway |
| "Berol 525" | Berol Kemi AB, Stenungsund, Sweden |
| "Berol 259" | Berol Kemi AB, Stenungsund, Sweden |
| Nonylphenol | Imperial Chemicals Ltd., London, England |

Using the same mixing conditions as applied for Examples 1 and 5 and with components otherwise as in Example 4, with none of the commercial emulsifiers stated above a homogenity has been obtained even approximately like what was achieved by the lignosulphonate, and normally non-emulsified oil has been observed floating freely on the surface of the mixture. In no case a critical diameter has been observed below 4 inches for these mixtures.

Finally, it should be mentioned that an explosive mixture having a composition as in Examples 1, 2 and 3 was produced by a continuous mixing method according to Example 3 but in a larger apparatus having a mixing chamber volume of about 8 liters and with a feeding rate of 150 kgs per minute. The discharge from the mixing chamber was pumped through a hose of inner diameter 1½ inches and a length of 82 feet directly into a blast hole in an open cast iron ore mine. The blast hole diameters were from 8 to 12 inches. Upon initiation with two pentolite primers of 360 g in each blast hole such blasts detonated completely and showed very satisfactory blasting results.

I claim,

1. In an aqueous explosive composition which comprises at least one inorganic oxygen-supplying salt, at least one fuel and at least one thickener, the improvement according to which the composition has a water content of from 5 to 15% by weight, a content of not less than 3% by weight hydrocarbon oil and from 0.5 to 5.0% by weight of a water soluble lignosulphonate, said composition being free from self-explosive matter, nitroderivatives, nitric acid esters and chlorinated hydrocarbons.

2. An aqueous explosive composition as in claim 1 wherein the oxygen-supplying salt is selected from the group consisting of ammoniumnitrate, sodium nitrate, potassium nitrate, calcium nitrate and mixtures thereof.

3. An aqueous explosive composition as in claim 1 wherein the hydrocarbon oil is a petroleum fraction normally designated as a fuel oil.

4. An aqueous explosive composition as in claim 1 wherein an additional fuel is selected from the group consisting of particulate aluminum, magnesium, silicon and alloys or mixture thereof.

5. An aqueous explosive composition as in claim 1, wherein the thickener is selected from the group consisting of guar gums and xanthan gums.

6. An aqueous explosive composition as in claim 1 wherein the water soluble lignosulphonate is selected from the group consisting of ammonium, sodium, magnesium and calcium lignosulphonate with or without a content of carbohydrates originating from the process producing the lignosulphonate.

7. An aqueous explosive composition as in claim 1 wherein the thickener is crosslinked by means of an agent comprising a compound of a heavy metal from the periodical system group 4, 5 and 6 in its highest valency.

* * * * *